US007235167B2

(12) United States Patent
Hentsch et al.

(10) Patent No.: US 7,235,167 B2
(45) Date of Patent: Jun. 26, 2007

(54) METHOD FOR THE MANUFACTURE OF CORROSION RESISTANT AND DECORATIVE COATINGS AND LAMINATED SYSTEMS FOR METAL SUBSTRATES

(75) Inventors: Wolfgang Hentsch, Eadebeul (DE); Axel Krug, Ebersbach (DE); Reinhold Separautzki, Moeglingen (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/049,698

(22) Filed: Feb. 4, 2005

(65) Prior Publication Data

US 2005/0175785 A1 Aug. 11, 2005

(30) Foreign Application Priority Data

Feb. 7, 2004 (DE) ..... 10 2004 006 127

(51) Int. Cl.
*C25D 3/04* (2006.01)
*C25D 3/56* (2006.01)
*C25D 5/34* (2006.01)
*C25D 5/42* (2006.01)

(52) U.S. Cl. ..... 205/283; 205/205; 205/243; 427/576

(58) Field of Classification Search ..... 205/283, 205/243, 205, 170, 176, 178, 180, 181, 239, 205/291; 427/535, 569, 576
See application file for complete search history.

(56) References Cited

U.S. PATENT DOCUMENTS

| | | | |
|---|---|---|---|
| 5,656,335 | A | 8/1997 | Schwing et al. |
| 6,112,587 | A | 9/2000 | Oldenettel |
| 6,399,152 | B1 | 6/2002 | Goodrich |
| 6,703,135 | B1 | 3/2004 | Dietz et al. |
| 2002/0119259 | A1 | 8/2002 | Kamei et al. |
| 2002/0170460 | A1 | 11/2002 | Goodrich |

FOREIGN PATENT DOCUMENTS

| | | | |
|---|---|---|---|
| DE | 1 951 543 | | 4/1970 |
| DE | 259 640 | A1 | 8/1988 |
| DE | 196 21 861 | A1 | 12/1997 |
| DE | 197 02 566 | A1 | 2/1998 |
| DE | 197 45 407 | C2 | 11/1998 |
| DE | 197 34 323 | A1 | 2/1999 |
| DE | 198 07 823 | A1 | 9/1999 |
| DE | 199 34 323 | A1 | 1/2001 |
| DE | 199 56 206 | A1 | 3/2001 |
| DE | 100 04 555 | A1 | 8/2001 |
| DE | 102 33 120 | A1 | 2/2004 |
| DE | 102 42 555 | A1 | 3/2004 |

(Continued)

*Primary Examiner*—Michael E. LaVilla
(74) *Attorney, Agent, or Firm*—Crowell & Moring LLP

(57) ABSTRACT

A method for the preparation of corrosion-resistant and decorative coatings and layer systems for substrates of metals, preferably light metals. Also, method for the production of a coating and a layer system for substrates of metal, with which a decorative and corrosion-resistant, heavy-duty surface can be produced, including applying an adhesion layer (e.g., by chromatization) and a lacquer layer and a plasma etching process for the pre-treatment and improved adhesion of the subsequent layers, or PVD layers from oxides or metals. Providing PVD layers of a metal or metal alloys, and copper, nickel chromium which are chiefly galvanically applied are also preferably included.

6 Claims, 1 Drawing Sheet

FOREIGN PATENT DOCUMENTS

| | | | |
|---|---|---|---|
| EP | 0 632 847 B1 | | 12/1996 |
| EP | 0 475 145 B1 | | 1/2000 |
| WO | WO 96/18753 | | 6/1996 |
| WO | WO99/43869 | * | 9/1999 |
| WO | WO 01/56781 A1 | | 8/2001 |

* cited by examiner

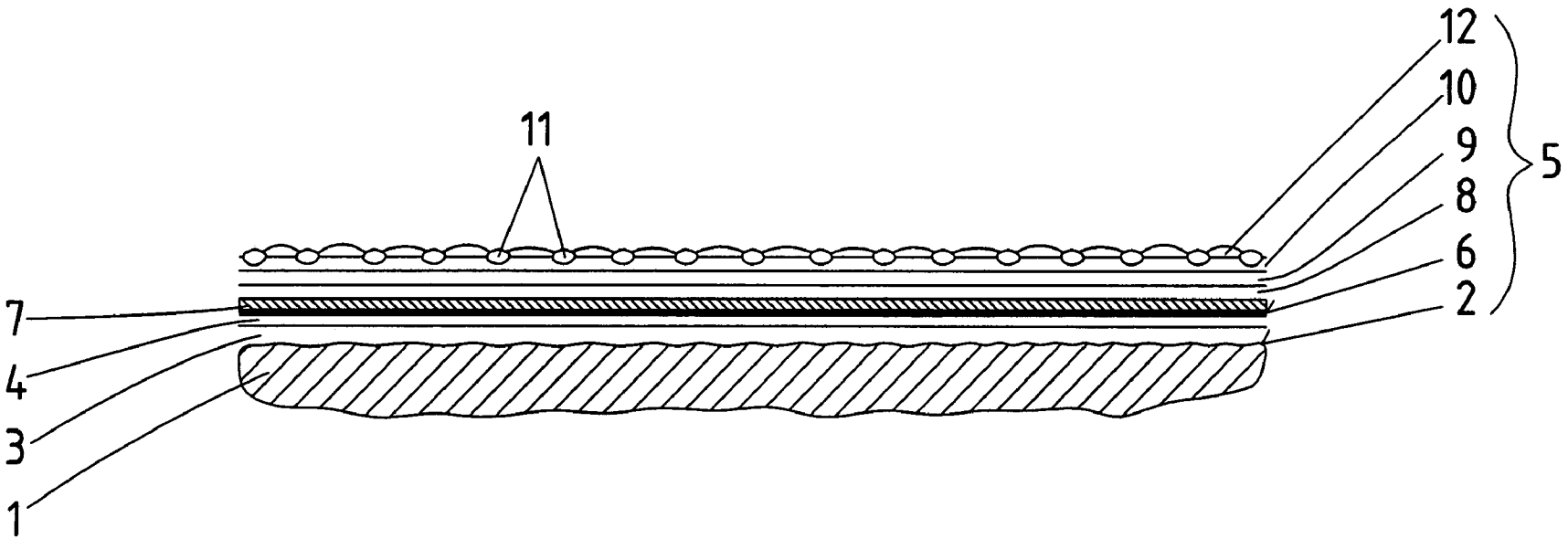
5
12
10
9
8
6
2
11
7
4
3
1

METHOD FOR THE MANUFACTURE OF CORROSION RESISTANT AND DECORATIVE COATINGS AND LAMINATED SYSTEMS FOR METAL SUBSTRATES

This application claims the priority of German Patent Document No. DE 10 2004 006 127.0, filed Feb. 7, 2004, the disclosure of which is expressly incorporated by reference herein.

BACKGROUND AND SUMMARY OF THE INVENTION

The invention relates to a method for the manufacture of corrosion resistant and decorative coatings and layered systems for substrates of metal, preferably light metals.

It is known to provide vehicle wheels of steel or also of light metal alloys with galvanic coatings, e.g., copper, chromium, nickel.

In the galvanic process, especially in the case of steel wheels, bath liquids from the galvanic process are left in the gap zones between the dish and the rim and, due to the capillary action, especially in the porosities. In the interstitial areas, furthermore, no continuous coating takes place. Both conditions lead later on to corrosion and partial destruction of the galvanic coating. In the case of light-metal wheels the galvanic coating furthermore leads to undesired changes in the tension conditions at the surface of the wheel, which can also have an effect on the operation and life of the wheel.

Known galvanic processes involve much material due to the required coating thicknesses and lead to a perceptible increase of the weight of the coated wheels. Thus, the weight of a light-metal wheel of the size 8J×17" increases by an average of about 1 kg due to the thick copper layers needed in order to smooth out the surfaces.

DE 19621 861 A1 shows a method for chromium plating an automobile rim from an aluminum alloy, in which first a ground coat of powder or wet lacquer is applied to the wheel surface. Then a coating of a galvano-ABS plastic is applied to this ground coat and then galvanically coated with chromium. The limits of the use of this coating result mainly from the limited temperature stability of the galvano-ABS plastic, which causes the coating to become detached in areas subjected to great thermal stress areas of the wheel.

Setting out from this state of the art it is an object of the invention to provide a method for the production of a coating and a layered system for substrates of metal, whereby a decorative and corrosion-resistant, heavy-duty surface can be produced.

According to the invention, this problem is solved by the following features. It is proposed to apply the following build-up of layers on the substrate:

Adhesion layer (e.g, by chromation)

Lacquer coat

Plasma etching process for the pretreatment and improved adhesion of the coatings that follow, or PVD coatings of oxides or metals for the same reason Mainly galvanically applied copper, nickel chromium.

Advantageously, due to the adhesion layer, the adhesion of the lacquer coat and thus the resistance to corrosion is markedly increased. The lacquer coat evens out, e.g., fills out seams and other problem areas and permits a continuous coating. In the case of light-metal rims, the special advantage is achieved that porosity is sealed and thus the penetration of process fluids is prevented. Also the surface of the light-metal substrate is generally protected against the action of process fluids, which leads to a perfect preservation of the properties of the material.

Advantageous further developments of the invention are set forth herein.

The actual application of the layer system can be preceded by a mechanical smoothing of the surface, for example, by drag grinding. This treatment favors later added thinner coatings and thus has an influence on the wheel weight.

The adhesion layer is applied preferably by chromatizing or phosphatizing or other environmentally friendly replacement methods (Cr6-free).

The ground coat of lacquer can consist, for example, of an EP lacquer which is baked on at 180° C. to 210° C. in order to achieve an outstanding surface flow. The surface of the ground coat of lacquer is what determines the surface quality of the chromium plating system.

Preferably, the surface of the lacquer ground coat is etched in vacuo, for example by treating it with plasma by plasma technology with the addition of chemically active process gases. By plasma technology coating, especially by a PVD method, e.g. by a metal or oxide flash, a continuous flash coating is applied to the surface thus treated. Chromium is used preferably for this purpose. The flash coating differs from a carrier coating in that it needs not to be optically dense nor electrically conductive. Both measures—the etching and the flash coating—serve for the improved adhesion of the metal intermediate coating next following, which can consist preferably of copper but also of nickel or nickel compounds. With this process a uniform, tridimensional coating of the surface is possible up to a thickness of 20 μm is possible.

The final chromium coating can now be applied to the electrically conductive intermediate coat thus produced.

An ordinary galvanic process can be used preferably for this purpose. The first coat to be applied is a coating of copper or semigloss nickel up to a coat thickness of 150 μm. Onto this coating the further build-up is performed with semigloss nickel, microporous nickel, and thereafter chromium. The term, "microporous nickel," is understood to mean an electrolytically applied nickel coating which contains finely divided solids in suspension. These nonconductive particles, held afloat in the electrolyte by air injection, are built into the deposit. In a subsequent chromium plating the inclusions are not chromium plated and form micropores in the deposit (see also Metzger, W; Ott, R: Galvanotechnik 61 (1970), p. 998 sqq.)

Alternatively, a galvanically produced coating of copper, semigloss nickel or a combination thereof can be applied to the intermediate layer. Additional galvanically produced layers are possible. As the final galvanically applied layer, however, a microprous nickel coating is provided, onto which the final chromium layer is applied by a PVD deposit. This combination yields a greater protection against corrosion which is fully functional without a lacquer cover coating.

The invention is further described with the aid of the embodiment shown in the single figure.

An aluminum body, here a rim 1, was deburred and then pretreated by drag grinding. For drag grinding the rim was immersed in a tub with abrasive bodies and agitated. The drag grinding produced a smoothed but not polished surface.

To build up layers, first a chromate coating 2 was applied as an adhesion layer. A ground lacquer coat 3 followed the chromate coating, of EP lacquer, for example, in a thickness of 50 to 60 μm, which was baked on at 180° C. to 210°. The ground coat 3 can be supplemented, if desired, with an additional lacquer layer 4, especially if any reworking of the ground lacquer coating 3 has become necessary, such as the grinding down of bubbles or inclusions.

The rim 1 is no longer electrically conductive due to the lacquer coats 3 and 4 and is protected against contact with liquids.

To prepare it for the application of a chromium coating system 5 the rim is etched at the surface to be coated. For this purpose the rim 1 was treated in a vacuum chamber (not shown) with plasma, with the addition of chemically active process gases. For further improvement of the strength of adhesion a metal flash coating 6 of chromium is applied by a method of plasma technology (for example, by means of PVD or CVD processes). The metal flash coating has a thickness of 5 to 20 nm.

By an additional plasma technology coating, a copper coating 7 is then applied by a physical method in a thickness of about 0.3 μm for the purpose of producing an electrically conductive intermediate layer for the galvanic processes to follow.

A chromium plating system was then applied in a conventional manner to the base thus created. A nickel coating 9 was galvanically applied to a likewise galvanically produced copper coating with a thickness of 25 μm. An additional microporous nickel coating 10 is formed and is deliberately provided with inclusions 11 which were built into the nickel deposit during the galvanic process in the form of suspended solids which are not electrically conductive. The coating thickness of the two nickel layers 9 and 10 totals 15 μm. The final chromium coating 12 has a thickness of 0.3 to 0.5 μm and completes the chromium coating system 5. Instead of the galvanically applied chromium coating 12 it is also possible to apply the chromium layer 12 by a PVD process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a highly lustrous coating on substrates of light metal or light metal alloys by the following steps:

applying an adhesion layer to the substrate, wherein the applying an adhesion layer includes chromatizing or phosphatizing;

lacquering to produce a lacquer coating;

coating with a metal by plasma vapor deposition; and chrome plating, said chrome plating comprising galvanic application of at least a first layer.

2. A method according to claim 1, further comprising preliminary treatment of the substrate with a mechanical smoothing of the surface.

3. A method according to claim 2, wherein said mechanical smoothing involves drag grinding.

4. A method according to claim 1, further comprising etching the lacquer coating before the plasma vapor deposition coating and after the plasma vapor deposition coating step applying a sealing interlayer selected from the group consisting of metals, metal alloys and metal oxides, in a plasma vapor deposition step.

5. A method according to claim 1, wherein the chrome plating comprises:

galvanically applying a first coat of copper, semigloss nickel or a combination thereof, galvanically applying a second coat of semigloss nickel or of a microporous nickel coating, and galvanically applying a coating of chromium.

6. A method according to claim 1, wherein the chrome plating comprises the following steps:

galvanically applying a first coating of copper, semigloss nickel or a combination thereof, galvanically applying a microporous second layer of nickel, and chromium coating with a plasma vapor deposition process.

* * * * *